US005556158A

United States Patent [19]

Wiecek

[11] Patent Number: 5,556,158

[45] Date of Patent: Sep. 17, 1996

[54] MECHANISM FOR RECLINING FURNITURE

[75] Inventor: Glenn N. Wiecek, Shelbyville, Ky.

[73] Assignee: L&P Property Management Co., Chicago, Ill.

[21] Appl. No.: 276,987

[22] Filed: Jul. 19, 1994

[51] Int. Cl.[6] ..... A47C 1/02

[52] U.S. Cl. ..... 297/85

[58] Field of Search ..... 297/85

[56] References Cited

U.S. PATENT DOCUMENTS

| | | | |
|---|---|---|---|
| 3,300,243 | 1/1967 | Mizelle | 297/85 |
| 3,400,975 | 9/1968 | Rogers, Jr. | 297/85 X |
| 3,758,151 | 9/1973 | Re . | |
| 4,108,491 | 8/1978 | Rogers, Jr. . | |
| 4,244,620 | 1/1981 | Harrison et al. | 297/85 |
| 4,249,772 | 2/1981 | Rogers, Jr. . | |
| 4,307,912 | 12/1981 | Watt et al. | 297/85 |
| 4,337,977 | 7/1982 | Rogers, Jr. et al. . | |
| 4,367,895 | 1/1983 | Pacitti et al. . | |
| 4,805,960 | 2/1989 | Tacker | 297/85 |
| 4,863,215 | 9/1989 | Crum | 297/85 |
| 4,915,444 | 4/1990 | Rogers, Jr. | 297/85 X |
| 5,192,113 | 3/1993 | Wiecek | 297/85 |

FOREIGN PATENT DOCUMENTS

| | | | |
|---|---|---|---|
| 644563 | 7/1962 | Canada | 297/85 |
| 866012 | 3/1971 | Canada | 297/85 |
| 813909 | 5/1939 | United Kingdom | 297/85 |

*Primary Examiner*—Peter M. Cuomo
*Assistant Examiner*—David E. Alred
*Attorney, Agent, or Firm*—Wood, Herron & Evans, P.L.L.

[57] ABSTRACT

A two position linkage mechanism for reclining an item action furniture between a fully upright position and a "TV" position. In the fully upright position, a footrest portion of the mechanism is fully retracted and a backrest portion of the mechanism is disposed at a first angle relative to a seat portion of the linkage. In the "TV" position, the footrest portion of the mechanism is fully extended, the seat portion of the mechanism moves forwardly, and the backrest portion of the linkage is disposed at a second, "opened up" or larger angle relative to the seat portion of the linkage.

21 Claims, 2 Drawing Sheets

10
12
14
18
20
21
24a
26
28
30
32
34
36
38
40
42
44
46
48
50
52
54
56
58
60
62
64
66
68
70
72
74
76
78
80
82
84
86
88
90
92
94
96
98
100
102
104
106
108
110
112
114
116
118
246
α

MECHANISM FOR RECLINING FURNITURE

BACKGROUND OF THE INVENTION

The present invention generally relates to reclining or action furniture and, more particularly, to the linkage assembly of a reclining piece of furniture having a movable seat, backrest and footrest.

Conventional reclining furniture mechanisms have generally taken two forms. In one form, usually referred to as a "two-way" mechanism, the seat is fixed to the backrest as a unitary structure so that the angle therebetween remains the same during reclining motion. In the other conventional form, usually referred to as a "three-way" mechanism, the item of furniture will have a fully upright position, a "TV" position and a fully reclined position. With these three-way mechanisms, the top of the backrest will angle downwardly and rearwardly relative to the seat as the piece of furniture moves from the "TV" or intermediate position to the fully reclined position. Likewise, the backrest will move or tilt back up as the chair moves from the fully reclined position to the "TV" position.

In a manner similar to reclining furniture utilizing conventional two-way mechanisms, furniture utilizing three-way mechanisms reclines from the fully upright to the "TV" position such that the angle between the seat and the backrest remains constant. In this regard, the seat and backrest may or may not be angled or tilted rearwardly together during this movement, however, any such angular movement has nevertheless resulted in the backrest being disposed at the same angle relative to the seat in both the fully upright and the "TV" or intermediate position.

It has been found that the two general positions which have been provided by past three-way reclining mechanisms for the "TV" position may each be unsatisfactory in terms of the comfort they provide for the occupant. That is, some mechanisms have provided only extension of the footrest and no change in the angular positions of the seat and backrest from the fully upright position. This design causes the chair or piece of furniture to be too upright and therefore uncomfortable for some occupants especially during prolonged periods in the chair or item of furniture. Other mechanisms which provide for rearward tilting of both the backrest and seat in the "TV" position relative to the fully upright position are also uncomfortable for some occupants as a result of the front of the seat being angled upwardly.

Another problem associated with conventional three-way recliners is the annoying occurrence of unintended rearward movement of the chair back from the "TV" position toward the full recline position. This is especially prevalent with heavier occupants of the item of furniture who will naturally exert more force against the backrest when occupying the item of furniture in its "TV" position. Measures have been taken in the past to alleviate this problem such as by providing adjustable spring tensioning capability in the reclining mechanism. However, these measures add cost and complexity to the mechanism and, in the large number of cases in which the consumer never even intends to use the full recline position, this added cost and complexity is wasted and unnecessary.

It has therefore become apparent that there is a need in the art for reclining furniture which provides more comfortable and stable seating in a "TV" position yet which uses less complicated and less costly mechanisms than those currently available.

SUMMARY OF THE INVENTION

In furtherance of providing improvements to the art of reclining furniture and specifically to reclining mechanisms, it has therefore been one object of the present invention to provide a mechanism for use in reclining furniture which provides a more comfortable "TV" seating position.

More specifically, it has been an object of this invention to provide a reclining mechanism that causes the backrest to "open up" or angle rearwardly relative to the seat when the item of reclining furniture is in a "TV" position.

It has been another object of the present invention to provide a relatively simple reclining mechanism for achieving the above objects.

It has been still another object of the invention to provide a reclining mechanism which maintains the backrest in a rigid state relative to the seat while maintaining a high level of comfort for the occupant and while keeping the cost and complexity of the mechanism low.

To these ends, the present invention generally comprises a two position linkage mechanism for reclining an item of action furniture, such as a chair, between a fully upright position and a semi-reclined or "TV" position. More specifically, an item of action furniture utilizing the mechanism of this invention includes a seat, a backrest and a footrest each being movable relative to the other during movement between the fully upright position and the "TV" position. In the fully upright position, a footrest portion of the mechanism is fully retracted and a backrest portion of the mechanism is disposed at a first angle relative to a seat portion of the linkage. In the "TV" position, the footrest portion of the mechanism is fully extended, the seat portion of the mechanism moves forwardly, and the backrest portion of the linkage is disposed at a second, "opened up" or larger angle relative to the seat portion of the linkage.

The linkage mechanism specifically includes a seat link and a base mounting plate interconnected by drive linkage, footrest linkage, backrest linkage and seat actuating linkage. A seat is adapted to be bolted to the seat link and the base mounting plate is adapted to be bolted to stationary frame structure, such as the wooden frame of the item of furniture. In accordance with the present invention, backrest linkage is operatively connected to a drive link and to the seat link such that, upon reclining movement of the item of furniture, the backrest will "open up" or angle rearwardly and downwardly with respect to the seat.

The drive linkage of the present invention is of the "over center" type which will automatically continue its movement after passing an over center position and until stopped by one or more appropriately placed stop members in the linkage assembly. Preferably, actuation of the mechanism takes place by the occupant applying pressure to the seat back while sitting in the item of furniture. In this manner, the drive links pivot about lower connections with the base link and move the seat link and the attached seat in a forward direction. This forward movement of the seat link preferably takes place without any significant angular movement thereof. At the same time, the backrest linkage moves the backrest to a comfortable, slightly reclined position relative to the seat. In the preferred embodiment, the backrest "opens up" or reclines approximately 10° with respect to the angle of the seat. That is, the angle between the seat and the backrest is approximately 10° greater in the "TV" position than in the fully upright position.

In the preferred embodiment of the invention the mechanism is a two position mechanism and therefore there is no full recline position provided by the mechanism as there is in more complicated three position mechanisms. As a result, this mechanism eliminates much of the linkages associated with conventional three position mechanisms and provides a relatively inexpensive and easily manufactured mechanism. An item of furniture utilizing this mechanism is easily brought to the unique, comfortable "TV" position described above. Moreover, as the mechanism is rigidly stopped at this comfortable "TV" position, there is no chance of unintentional and annoying movement from the "TV" position toward a full recline position due to the weight of the occupant or due to pressure applied to the backrest as by a person leaning on the backrest of the item furniture from behind.

These and other objects and advantages of the present invention will become more readily apparent to those of ordinary skill in the art upon review of the following detailed description of the preferred embodiment taken in conjunction with the accompanying drawings.

DETAILED DESCRIPTION OF THE PREFERRED EMBODIMENT

Figure 1:
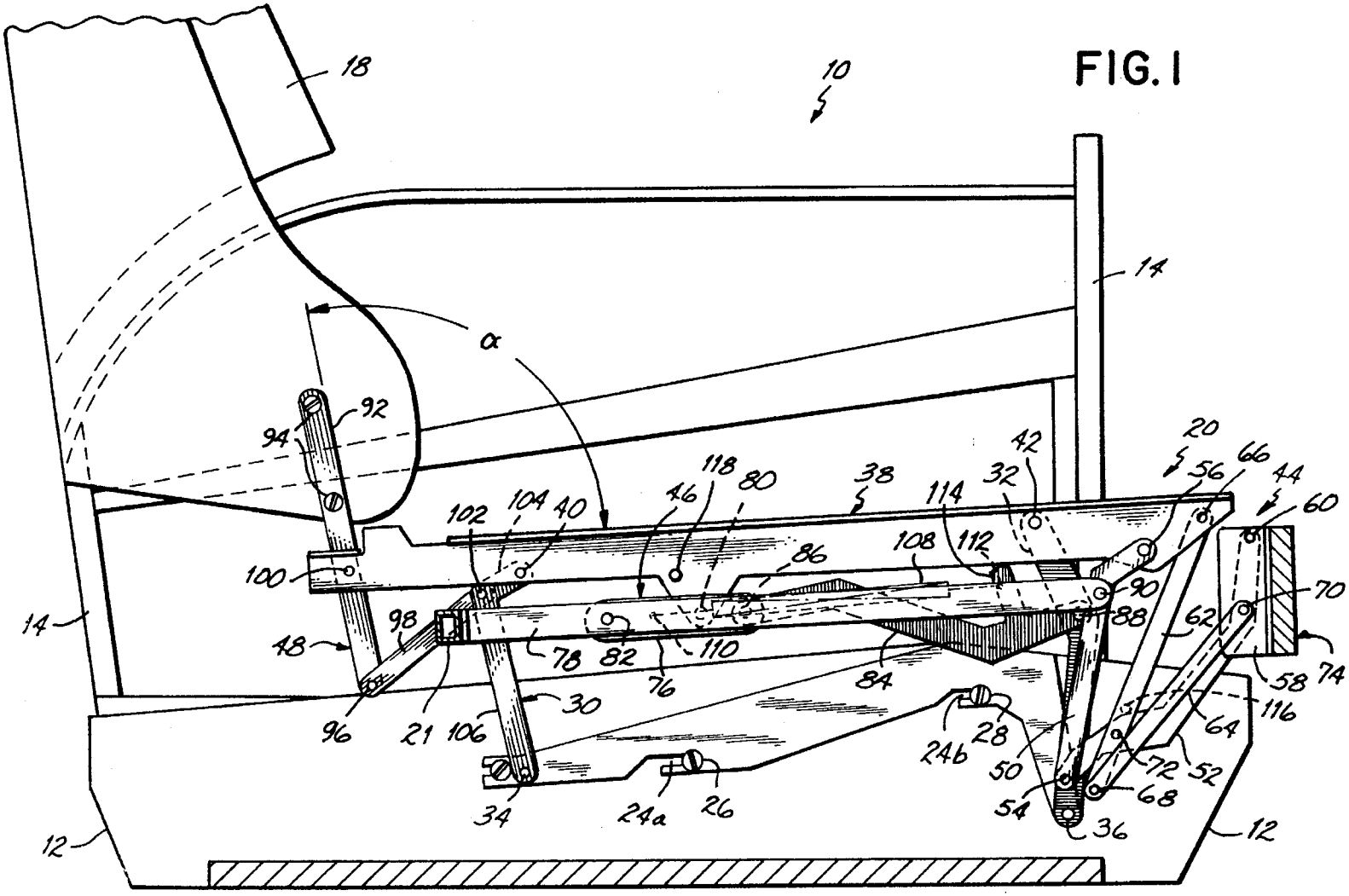
FIG. 1 is a side elevational view of an item of reclining furniture, which could be a could be a reclining chair, incorporating a preferred embodiment of the inventive mechanism with the mechanism being shown in a fully upright position; and, FIG. 2 is a side elevational view similar to FIG. 1 but showing the mechanism in the "TV" position provided by the present invention.

Referring first to FIG. 1, there is illustrated an item of action furniture 10 which could be a reclining chair or sofa or any type of action furniture which includes a stationary base frame 12, arm frame structure 14, and a backrest frame 18. Seat frame structure (not shown) is also provided for supporting seat cushion structure in a conventional manner. In the preferred embodiment, the item of action furniture 10 with which the invention of this application is employed is a reclining chair having, for example, a wooden frame but it could as well be a reclining sofa or any other type of action furniture which utilizes a seat, backrest and footrest movable between a fully upright and a "TV" position as described in accordance with this invention. To accomplish this movement of seat, backrest and footrest, the item of action furniture 10 incorporates the improved linkage mechanism 20 of the present invention.

The entire linkage mechanism of chair 10 actually comprises two substantially identical mechanisms 20 located on opposite sides of the item of furniture 10 and interconnected by appropriate cross pieces or cross bars such as cross bar 21 and other seat frame members (not shown), as necessary. Since the two mechanisms on either side of the item 10 of furniture are substantially identical and mirror images of one another, only one linkage mechanism 20 has been shown in the drawings and described herein for the purposes of simplicity. Also, although the use of an actuating mechanism, such as a conventional cable actuator or lever, has not been shown in the drawings, it will be appreciated that such an actuating mechanism may be readily incorporated in linkage mechanism 20 of the present invention rather than having the occupant actuate mechanism 20 by leaning back on the backrest as will be described. As one example, a cable actuating mechanism may be employed as disclosed in pending U.S. patent application Ser. No. 08/229,384, filed Apr. 18, 1994. This patent application, entitled Mechanism for Reclining Furniture, is assigned to the assignee of the present application, and is hereby expressly incorporated by reference herein in its entirety.

As shown in FIG. 1, linkage mechanism 20 comprises a base mounting plate 24 having slots 24*a*, 24*b* formed therein for facilitating attachment of mounting plate 24 to a floor mounted side rail of the base frame structure 12 by way of fasteners such as screw fasteners 26, 28. Extending upwardly from mounting plate 24 are a pair of drive links 30, 32. Rear drive link 30 is pivotally attached to the rear of base mounting plate 24 by pivot connection 34 while front drive link 32 is pivotally attached to the front of base mounting plate 24 by a pivot connection 36. A seat link 38 is supported from the drive links 30, 32 by respective upper pivot connections 40, 42 made between seat link 38 and upper ends of drive links 30, 32. Linkage mechanism 20 further generally comprises footrest linkage 44, footrest actuating linkage 46 and backrest linkage 48.

Still referring to FIG. 1, footrest linkage 44 is suspended from the front of seat link 38. Footrest linkage 44 comprises conventional scissor-type linkage which is fully shown only in FIG. 1 for clarity. Footrest linkage 44 comprises a rear footrest link 50 and a front footrest link 52 connected together at a pivot connection 54, An opposite end of rear footrest link 50 is connected to seat link 38 by a pivot connection 56 while a front end of front footrest link 52 is connected to a footrest support link 58 at pivot connection 60. Footrest linkage 44 further comprises respective first and second footrest connecting links 62, 64. The first footrest connecting link 62 is pivotally connected at its upper end by a pivot connection 66 to seat link 38. At its lower end, first footrest connecting link 62 is connected to second footrest connecting link 64 by pivot connection 68. The upper end of the second footrest connecting link 64 is pivotally connected to footrest support link 58 by a pivot connection 70. The foot link pair 50, 52 are also interconnected with foot link pair 62, 64 intermediate their ends by a pivot 72 at the juncture of link 52 and link 62. A footrest 74 is in turn fixed to the front or upper face of footrest support link 58 in a known manner.

Figure 2:
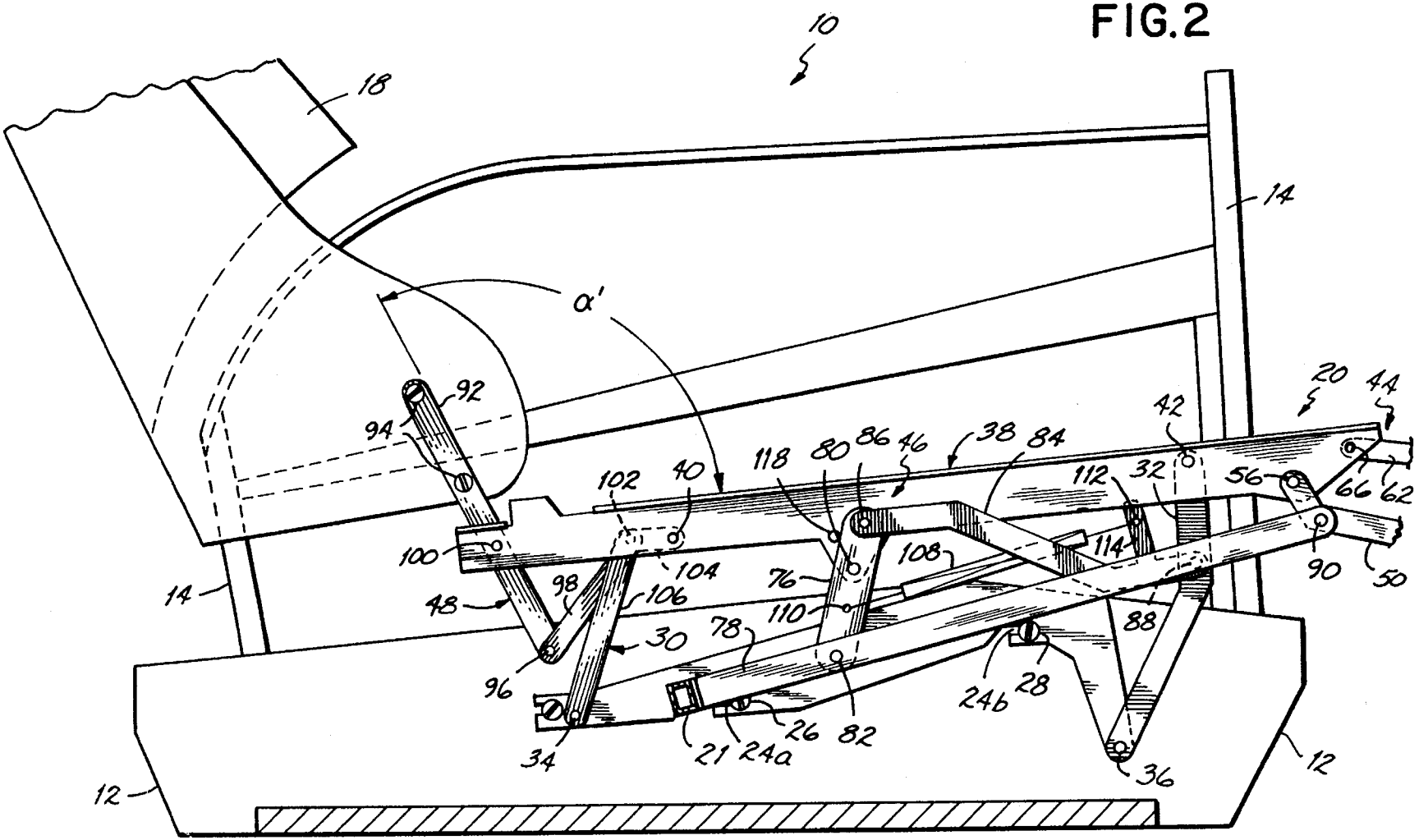

In order to effect extension and retraction of the footrest and movement of the chair 10 from a fully upright position to the "TV" position of the present invention, linkage mechanism 20 includes the previously mentioned footrest actuating linkage 46 as shown in FIGS. 1 and 2. Footrest actuating linkage 46 includes an actuating link 76 and a footrest drive link 78. Actuating link 76 is pivotally connected at a location between its opposite ends to seat link 38 by a pivot connection 80 and is further pivotally connected to footrest drive link 78 by a pivot connection 82 disposed at a rear end of the actuating link 76 as viewed in FIG. 1. As further viewed in FIG. 1, the front end of actuating link 76 is connected to a ratio connecting link 84 by way of a pivot connection 86. The opposite end of ratio connecting link 84 is pivotally attached to the front drive link 32 at pivot connection 88 which is disposed intermediate the opposite ends of front drive link 32. The forward end of footrest drive link 78 is connected to rear footrest link 50 by way of a pivot connection 90 which is disposed intermediate the opposite ends of rear footrest link 50.

It will be appreciated that if actuating link 76 is rotated counterclockwise as viewed in FIG. 1, and about pivot 80, this rotation will cause ratio connecting link 84 to pull seat link 38 forwardly and simultaneously rotate front drive link 32 clockwise about its lower front pivot 36. Consequently, rotation of the actuating link 76 in a counterclockwise direction as viewed in FIG. 1 results in seat link 38 being pulled forwardly as the front and rear drive links 32 and 30 rotate in a clockwise direction and as footrest linkage 44 is extended. This would be the direct course of events if a cable actuating mechanism were used with linkage mechanism 20, however, as will be explained below, the preferred method of actuation is through application of enough force against the backrest to cause backrest linkage 48 to initiate movement of mechanism 20 in this manner.

Backrest linkage 48 supports backrest frame 18 for pivotal movement relative to seat link 38 during reclining movement of chair 10 between the fully upright position shown in FIG. 1 and the semi-reclined "TV" position shown in FIG. 2. Backrest linkage 48 comprises a backrest link 92 and a backrest control link 98. Backrest link 92 is rigidly secured to the backrest frame 18, for example, by screw fasteners 94. A lower end of backrest link 92 is pivotally connected to backrest control link 98 by a pivot connection 96. Intermediate the rigid connection of backrest link 92 to backrest frame 18 and lower pivot connection 96, backrest link 92 is pivotally connected to seat link 38 by a pivot connection 100. Backrest control link 98 extends forwardly at an upward angle from pivot 96 and is pivotally connected at its upper end to rear drive link 30 at pivot connection 102. More specifically, rear drive link 30 is shaped generally as an inverted "L" and upper pivot connection 102 of backrest control link 98 is located generally at the junction between a shorter leg or crank portion 104 of the "L" shaped drive link 30 and a longer support portion 106 of drive link 30. In the fully upright position of FIG. 1 backrest control link 98 extends approximately in line with portion 104 of drive link 30 while in the "TV" position of FIG. 2, link 98 extends at a greater upward angle and drive link portion 104 is approximately horizontal.

OPERATION OF THE LINKAGE MECHANISM

Referring first to FIG. 1, when chair 10 is in a fully upright position, linkage mechanism 20 is maintained in this position by a spring 108 connected between a hole 110 in actuating link 76 and a hole 112 in an upwardly extending portion 114 of ratio connecting link 84. Spring 108 applies a rearward biasing force to front drive link 32 through ratio connecting link 84 to maintain pivots 40, 42 rearward of their "over center" positions. In other words, spring 108 provides resistance to forward action of seat link 38 and drive links 30, 32 which would result in extension of footrest linkage 44. Biasing force provided by spring 108 therefore maintains a stop stud 116 of footrest connecting link 62 against an upper surface of front footrest link 52. As is known in the art, further stop studs may be placed in various appropriate locations within linkage mechanism 20 to positively halt the movement of mechanism 20 in the position shown in FIG. 1.

When a person is seated in the chair or piece of action furniture 10 and linkage mechanism 20 is in a fully upright position with the footrest fully retracted as shown in FIG. 1, the weight of the person seated in chair 10 tends to bias seat link 38 rearwardly because of the orientation of the pivot connections 36, 42 between front drive link 32 and mounting plate 24 and front drive link 32 and seat link 38, respectively. To initiate reclining movement of chair 10, seat link 38 must be moved "over center" or forwardly to a point at which upper pivot connection 42 of front drive link 32 moves forwardly of lower pivot connection 36 of this same front drive link 32. When this occurs, the weight of the person seated in chair 10 tends to continue to force the drive links 30, 32 to pivot in a clockwise direction about their respective pivot connections 34, 36 to mounting plate 24.

To initiate forward movement of seat link 38 relative to mounting base plate 24, the chair occupant simply leans back or applies force against the backrest of chair 10. This causes seat link 38 to move forward relative to stationary base plate 24. Actuating link 76 will rotate in a counterclockwise direction about pivot 80 as viewed in FIG. 1 and footrest drive link 78 will move downwardly to extend footrest linkage 44. Once this reclining movement is initiated, and as soon as pivot 42 of front drive link 32 moves forwardly of the lower pivot connection 36 of front drive link 32, the opening or extending movement of footrest linkage 44 will continue as a consequence of the weight of the person in the chair 10 causing clockwise rotation of front drive link 32 and forward movement of seat link 38 through ratio connecting link 84 and further assistance provided by tension spring 108. This opening movement of footrest linkage 44 will continue until, for example actuating link 76 hits stop stud 118 on seat link 38 as shown in FIG. 2. As is conventional, footrest linkage 44 preferably also includes an appropriately located stop stud (not shown) for positively stopping the extension thereof.

In accordance with the main principles of this invention, when linkage mechanism is in the fully upright position shown in FIG. 1, backrest link 92 is disposed at an angle $\alpha$ with respect to seat link 38. Angle $\alpha$ may, for example, be approximately 100°. As linkage mechanism 20 is fully extended into the "TV" position, shown in FIG. 2, backrest link 92 is automatically pivoted-to a second, larger angle $\alpha'$. Backrest link 92 is rigidly stopped at this position by one or more appropriately placed stop studs, such as stud 116. Backrest link 92 is preferably "opened up" approximately 10° with respect to seat link 38 or, in other words, reclined and rigidly stopped at angle $\alpha'$ which is approximately 110° when the initial angle $\alpha$ is approximately 100° as mentioned above. It will be appreciated that with these angular relationships being established between seat link 38 and backrest link 92, which are respectively rigidly fastened to the backrest and seat of chair 10, the backrest of chair 10 will automatically "open up" or move rearwardly 10° relative to the seat of chair 10 when moving from the fully upright to the semi-reclined or "TV" position. Seat link 38 and therefore the seat of chair 10 preferably remain at substantially the same angle relative to horizontal in both the fully upright and "TV" positions as shown in FIGS. 1 and 2.

To move chair 10 back to the fully upright position shown in FIG. 1 from the "TV" position shown in FIG. 2, all the occupant needs to do is apply downward pressure on the footrest of chair 10. This reverses the motion of the various linkages of mechanism 20 described above until various appropriately placed stop members, such as stop stud 116, are engaged.

From the foregoing description, it will be appreciated that the present invention provides a simple, economical two position mechanism which may be used to easily operate an item of action furniture between a fully upright position and a rigid, comfortable "TV" position.

While a single preferred embodiment of the present invention has been shown and described, persons skilled in the art to which this invention pertains will readily appreciate many modifications and substitutions which may be made without departing from the spirit of the invention. Therefore, applicant does not intend to be limited except by the scope of the appended claims.

What is claimed is:

1. A linkage mechanism for an item of reclining furniture having a seat, a backrest and a footrest being movable between a fully upright position and a semi-reclined TV position, said mechanism comprising:

a base mounting plate;

front and rear drive links having lower ends pivotally connected at spaced locations to said base mounting plate;

a seat link, upper ends of said drive links being operatively connected to said seat link such that forward movement of said seat link causes forward pivotal movement of said drive links relative to said base mounting plate;

footrest linkage pivotally connected to a front end of said seat link for movement between fully retracted and fully extended positions;

actuating linkage connected generally between said front and rear drive links and between said base mounting plate and said seat link; and, a backrest link pivotally connected to said seat link at a first predetermined angle in said fully upright position and operatively connected to said rear drive link by a backrest control link pivotally connected directly between said backrest link and said rear drive link, wherein movement of said footrest linkage from said fully retracted position to said fully extended position causes said backrest control link to pivot said backrest link to a second, larger angle relative to said seat link and wherein the second, larger angle is maintained independent of a maintained application of rearward pressure on the backrest.

2. The mechanism of claim 1 wherein said second angle is substantially 10° larger than said first angle.

3. The mechanism of claim 2 wherein said first angle is substantially 100° and said second, larger angle is substantially 110°.

4. The mechanism of claim 1 wherein a pivot connection is made between said backrest link and said seat link at a location between opposite ends of said backrest link, said backrest control link having a first end pivotally connected to a lower portion of said backrest link relative said pivot connection, said backrest of said item of furniture being adapted to be rigidly fastened to said backrest link at an upper portion of said backrest link relative to said pivot connection.

5. The mechanism of claim 4 wherein upper ends of said front and rear drive links are connected by respective pivot connections to said seat link.

6. The mechanism of claim 5 wherein said rear drive link is shaped generally as an inverted "L" having a first leg and a second leg with said second leg being longer than said first leg and a second end of said backrest control link is pivotally connected to said rear drive link generally at a junction formed between said first leg and said second leg.

7. The mechanism of claim 6 wherein said backrest control link angles upwardly from said backrest link to said rear drive link.

8. The mechanism of claim 1 further including at least one stop member connected to a link in said mechanism and adapted to engage another link when said mechanism is in said TV position thereby rigidly stopping said backrest link at said second, larger angle.

9. The mechanism of claim 1 wherein said seat link is disposed at substantially equal angles relative to horizontal in both said fully upright and said TV position.

10. A two position linkage mechanism for an item of reclining furniture having a seat, a backrest and a footrest being movable between a first, fully upright position and a second, TV position, said mechanism comprising:

a base mounting plate;

front and rear drive links having lower ends pivotally connected at spaced locations to said base mounting plate;

a seat link, upper ends of said drive links being pivotally connected to said seat link such that forward movement of said seat link causes forward pivotal movement of said drive links relative to said base mounting plate;

footrest linkage pivotally connected to a front end of said seat link for movement between fully retracted and fully extended positions;

footrest actuating linkage connected generally between said front and rear drive links and between said base mounting plate and said seat link, said footrest actuating linkage being actuated by rearward pressure on said backrest and resulting forward movement of said seat link;

a backrest link pivotally connected to said seat link at a first predetermined angle in said fully upright position by a backrest control link pivotally connected directly between said backrest link and said rear drive link, wherein movement of said footrest linkage from said fully retracted position to said fully extended position causes said backrest control link to pivot said backrest link to a second, larger angle relative to said seat link and wherein the second, larger angle is maintained independent of a maintained application of rearward pressure on the backrest; and, a stop member connected to a link in said mechanism and adapted to engage another link when said mechanism is in said second, TV position thereby rigidly stopping said backrest link at said second, larger angle.

11. The mechanism of claim 10 wherein said second angle is substantially 10° larger than said first angle.

12. The mechanism of claim 11 wherein said first angle is substantially 100° and said second, larger angle is substantially 110°.

13. The mechanism of claim 10 wherein a pivot connection is made between said backrest link and said seat link at a location between opposite ends of said backrest link, said backrest control link having a first end pivotally connected to a lower portion of said backrest link relative said pivot connection, said backrest of said item of furniture being adapted to be rigidly fastened to said backrest link at an upper portion of said backrest link relative to said pivot connection.

14. The mechanism of claim 13 wherein said rear drive link is shaped generally as an inverted "L" and a second end of said backrest control link being pivotally connected thereto generally at a junction formed between a shorter leg portion and a longer leg portion of said rear drive link.

15. The mechanism of claim 14 wherein said backrest control link angles upwardly from said backrest link to said rear drive link.

16. The mechanism of claim 10 wherein said seat link is disposed at substantially equal angles relative to horizontal in both said fully upright and said TV position.

17. In a linkage mechanism for an item of reclining furniture having a seat, a footrest and a backrest movable between a fully upright position and a semi-reclined TV position, said mechanism including a seat link adapted to support said seat, a backrest link connected at a first predetermined angle to said seat link when in said fully upright position and adapted to support said backrest, a base mounting plate adapted to be connected to frame structure of said item of reclining furniture, and linkage connected between said seat link and said base mounting plate, said linkage including drive linkage connected with actuating linkage for moving said mechanism from said fully upright to said semi-reclined, TV position, wherein the improvement comprises:

a backrest control link operatively connected directly between said backrest link and a rear drive link of said drive linkage, said backrest control link and said rear drive link operative to pivot said backrest link from said first predetermined angle with respect to said seat link to a second, larger predetermined angle with respect to said seat link during movement of said mechanism from said fully upright position to said semi-reclined TV position and wherein the second, larger predetermined angle is maintained independent of a maintained application of rearward pressure on the backrest.

18. The mechanism of claim 17 further comprising at least one stop member disposed on one link in said mechanism and adapted to engage another link in said mechanism to thereby rigidly stop said backrest link at said second, larger angle.

19. The mechanism of claim 18 wherein said second angle is substantially 10° larger than said first angle.

20. The mechanism of claim 19 wherein said first angle is substantially 100° and said second, larger angle is substantially 110°.

21. The mechanism of claim 17 wherein said seat link is disposed at substantially equal angles relative to horizontal in both said fully upright and said TV position.

* * * * *